United States Patent [19]

DiBenedetto et al.

[11] 4,018,174

[45] Apr. 19, 1977

[54] SEWING MACHINE PRESSER FOOT ASSSEMBLY

[75] Inventors: Ernest A. DiBenedetto, Philadelphia; Harold S. Lerner, Norristown, both of Pa.

[73] Assignee: Gordon Clothes, Inc., Conshohocken, Pa.

[22] Filed: Jan. 23, 1976

[21] Appl. No.: 651,908

[52] U.S. Cl. ..... 112/235

[51] Int. Cl.[2] ..... D05B 29/08

[58] Field of Search ..... 112/235, 240, 236, 237, 112/238, 239, 60, 61

[56] References Cited

UNITED STATES PATENTS

| | | | |
|---|---|---|---|
| 1,300,184 | 4/1919 | Mittleberg | 112/235 |
| 3,735,718 | 5/1973 | Vizgirda et al. | 112/235 |
| 3,877,404 | 4/1975 | Oda | 112/240 |

FOREIGN PATENTS OR APPLICATIONS

| | | | |
|---|---|---|---|
| 441,510 | 1/1925 | Germany | 112/240 |

*Primary Examiner*—Werner H. Schroeder
*Assistant Examiner*—Peter Nerbun
*Attorney, Agent, or Firm*—Howson and Howson

[57] ABSTRACT

A sewing machine presser foot assembly adapted for the dual function of setting a concealed zipper and closing the seam below the zipper. The presser foot assembly comprises a zipper foot, and a cording foot bar pivotally mounted for selective movement between a raised inoperative position alongside the zipper foot and a lowered operative position beneath the zipper foot. In a preferred embodiment of the invention, means are provided for maintaining the cording foot bar in either the raised or the lowered position.

13 Claims, 9 Drawing Figures

SEWING MACHINE PRESSER FOOT ASSSEMBLY

The present invention relates generally to attachments for sewing machines and relates more particularly to a novel dual purpose presser foot assembly which permits the selective engagement of either a first or a second presser foot element with the material being sewn, means being provided for introducing one of said elements beneath the other element. The assembly is especially suited when equipped with a zipper foot and a cording foot bar for setting a concealed zipper and closing the seam below the zipper.

Concealed zippers, also known as invisible zippers, are employed in applications where it is desirable to hide the zipper from view. In the concealed zipper, the cooperating zipper teeth or coils which are engaged and disengaged by the slide fastener are located entirely on the back side of the zipper tapes and consequently cannot be seen when the zipper is closed. Although suited for a wide variety of uses, the concealed zipper is primarily employed in women's clothing to provide an inconspicuous and practically invisible closure.

Although concealed zippers provide a more attractive product, they have received only a limited acceptance by garment manufacturers, primarily because of the specialized techniques and equipment required for their installation. Due to the need for attaching each zipper tape by a stitch line through the tape which is actually underneath the zipper teeth or coil, a special zipper foot is required to set a concealed zipper. A widely used type of zipper foot especially adapted for the purpose of setting concealed zippers is illustrated in U.S. Pat. No. 3,492,960 issued on Feb. 3, 1970. In this type of foot, the sole of the foot includes a pair of spaced parallel grooves extending in the direction of the flow of the material through the machine. A needle hole in the foot passes between the grooves to accommodate the vertical recipricatory movement of the needle. Each side of the zipper is set utilizing one or the other of the foot grooves to temporarily dispose the zipper teeth or coil to one side and permit the stitch line to be established on the tape as close as possible to the teeth or coil.

The described type of special zipper foot works effectively and is used commercially for the production setting of concealed zippers. There is, however, a major disadvantage to such a foot, namely the unsuitable nature of the foot for use in closing the seam below the zipper, which is usually the next operation to be performed after the zipper has been set. The closing seam must start above the lower end of the zipper setting stitch lines and is made with the zipper at least partially closed. The closing seam stitch line should be located as close as possible to the zipper setting stitch lines to avoid pulling more material into the beginning of the sewn seam than has already been adopted by the zippered connection. A difficulty at the start of the seam closing operation stems from the presence of the closed zipper immediately adjacent the desired stitch line. Since the typical concealed zipper foot extends substantially to each side of the needle, it cannot be utilized to carry out the seam closing operation. In current commercial practice, it has accordingly been necessary prior to the present invention to have the seam closing operation carried out on a separate machine, utilizing a conventional cording foot which locates the stitch line along the edge of the cording foot, the needle operating partially within a recess in the foot edge. For this purpose, a left side cording foot is preferred which has the fabric-engaging sole of the foot bearing on the feed dogs on the left hand side of the needle hole only, so that the thickness of the zipper teeth or coil, may butt up against the right hand edge of the foot, resulting in a straight row of stitching consistently positioned in relation to the zipper teeth.

The necessity for carrying out the seam closing operations on a second machine greatly increases the time required for material handling and of course also necessitates an additional machine and operator. As a result, production is slowed and costs are increased. Furthermore, the quality of the zipper installation suffers since the use of a second machine allows possible variations in thread, stitch formation, and thread tension. Furthermore, inspection of the product is divided between two operators at two work stations.

An alternative is to make two separate sewing operations for the same machine by replacing the zipper foot with a conventional cording foot. This routine doubles the handling time as it necessitates positioning the same seam twice.

Attempts have been made to develop a zipper foot for setting concealed zippers which will also have the capability of closing the seam below the zipper. To date, however, those attempts have not been successful in developing a presser foot attachment which is suitable for use in a commercial operation. In U.S. Pat. No. 3,735,718 issued on May 29, 1973, a concealed zipper foot of the type described above has been modified to permit a transverse sliding movement of the foot to allow the needle to operate along on edge of the foot. Such a device has been marketed for domestic use but would not be satisfactory for production sewing. Its major drawback is the need for the operator to carefully gauge the transverse positioning of the zipper foot for each setting, since there are no stops for any of the possible foot positions. Repetitive positioning of the foot would accordingly be difficult, tiring, and time consuming. A further drawback is the lack of any means for preventing transverse movement of the foot during sewing operations. Finally, the shape of the typical zipper foot is not optimal for the seam closing operation and would not produce seams positioned consistently which is desired for production sewing.

In the present invention, a zipper foot assembly is provided comprising a concealed zipper foot which may be of the type generally described above and illustrated in U.S. Pat. No. 3,492,960. This foot is utilized in a conventional manner for the setting of the concealed zipper. A flat or nearly flat element similar in shape to the fabric-engaging bar of a cording foot, and hereinafter referred to as a cording foot bar, is pivotally mounted along one side of the zipper foot for selective movement between a raised inoperative position and a lowered operative position beneath the zipper foot. In the lowered position, the cording foot bar has the configuration of a conventional cording foot and is so used. In a preferred embodiment of the invention, means are provided to positively index the pivotally mounted cording foot bar in either the raised or the lowered position so that operator judgment is not required to position this element correctly. The change from the zipper foot to the cording foot configuration and vice versa may be quickly accomplished to enable the same operator to effect both the setting of a concealed zipper and the closing of the seam below the zipper in sequential operations on the same machine, by flipping down the cording foot bar. When the guidance of the cording foot bar is no longer needed, the cording foot bar can be 'flipped' up to the inoperative position and the seaming may be completed or the next zipper set.

It is accordingly a primary object of the present invention to provide a presser foot attachment for sewing machines which permits the selective engagement of either a first or a second presser foot element with the material being sewn by introducing one of said elements beneath the other element.

Another object of the invention is to provide a presser foot attachment as described which can be utilized for both the setting of a concealed zipper and the subsequent closing of the seam below the zipper.

A further object of the invention is to provide an attachment as described which incorporates in a single attachment all of the advantages of a conventional concealed zipper foot and also those of a conventional cording foot.

Another object of the invention is to provide an attachment as described which can be quickly and positively shifted from its zipper setting mode to its seam closing mode and vice versa.

Still another object of the invention is to provide an attachment as described of a simple, inexpensive design the use of which does not require special operator skills.

Additional objects and advantages of the invention will be more readily apparent from the following detailed description of an embodiment thereof when taken together with the accompanying drawings wherein.

Figure 1:
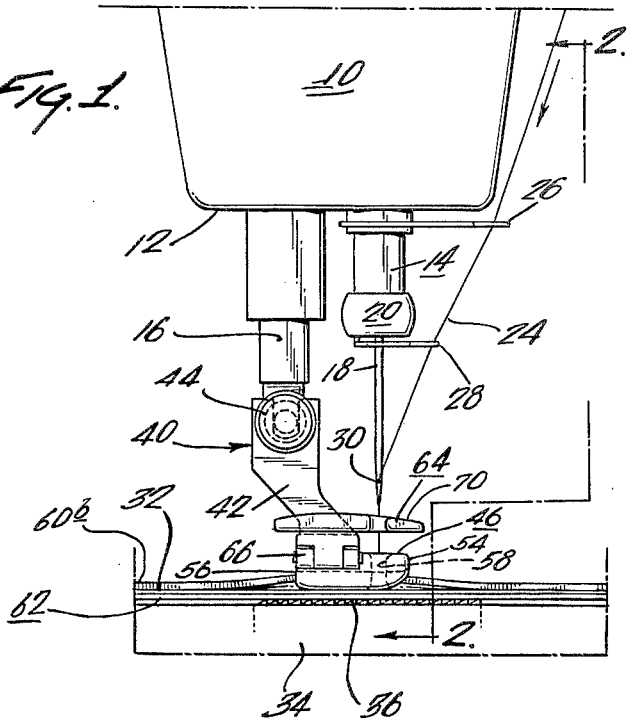
FIG. 1 is a partial side elevational view of a sewing machine having a presser foot attachment in accordance with the present invention and shown with the zipper foot thereof engaged in setting a concealed zipper.
Figure 2:
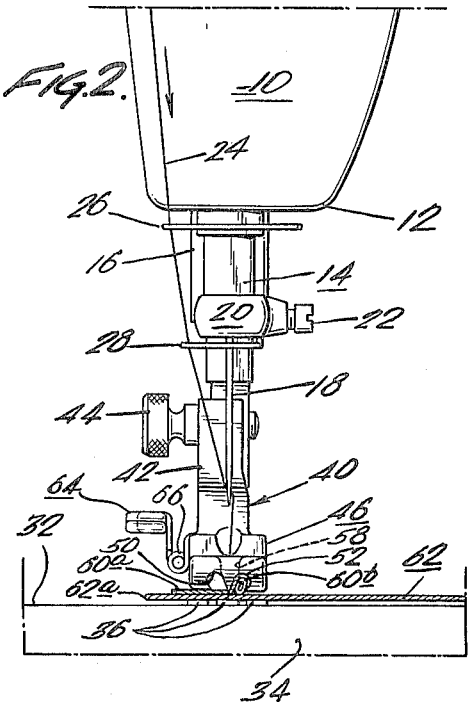
FIG. 2 is a front elevational view partly in section taken along line 2—2 of FIG. 1.
Figure 3:
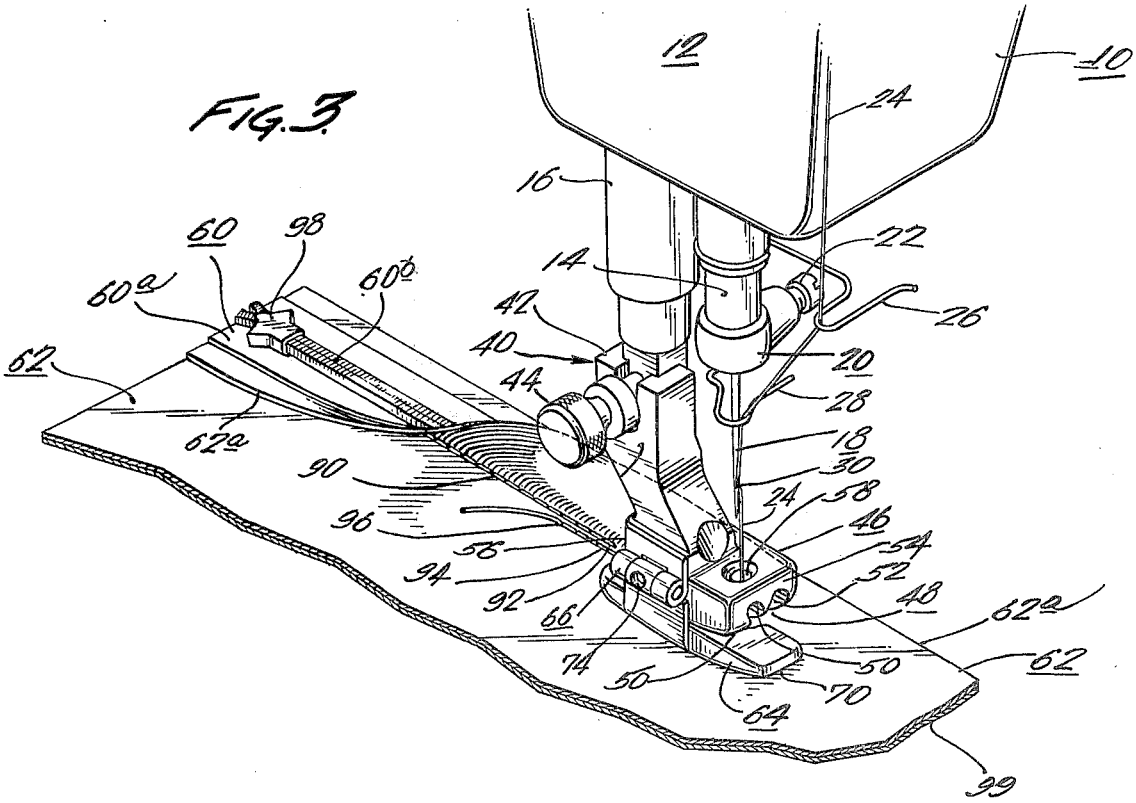
FIG. 3 is an enlarged perspective view of the apparatus shown in FIGS. 1 and 2 with the cording foot bar thereof in the lowered operative position and employed in the closing of the seam below the concealed zipper.

Referring to the drawings and particularly FIGS. 1–3 thereof, a portion of a sewing machine generally designated 10 is illustrated including the lower end 12 of the sewing machine head from which extend the needle bar 14 and the presser bar 16. A needle 18 is secured to the needle bar 14 by a needle clamp 20 controlled by a needle clamp screw 22. A thread 24 from a supply spool (not shown) passes through thread guides 26 and 28 and thence through eye 30 in the needle.

In a completely conventional manner, the vertical recipricatory movement of the needle bar 14 drives the needle downwardly through the material layers to be sewn disposed on a work supporting table 32 of the sewing machine bed 34. The thread bearing needle on descending into the bed 34 cooperates with a loop forming device (not shown) connected with a second thread source (not shown) to effect a conventional stitch forming operation. The material to be sewn is intermittently fed across the table 32 by a plurality of feed dogs 36 extending through slots in the table surface adjacent the needle. The material to be sewn is held in spring-biased relation against the feed dogs by a presser foot connected to the presser bar 16 which is spring loaded downwardly by a coil spring (not shown) within the machine head 12. It is the purpose of the present invention to provide as a sewing machine attachment, a novel presser foot assembly for mounting on the presser bar 16 of a sewing machine of holding the material being sewn against the feed dogs 36 during the several specialized operations involved in the setting of a concealed zipper and the closing of the seam below the zipper.

The present invention in the preferred illustrated embodiment comrises a presser foot assembly generally designated 40 having a shank portion 42 which includes a vertical groove 43 adapted to accept the lower end of the presser bar 16. A slot 45 in the upper end of the groove 43 accommodates the attachment screw 44 threadedly engaged in the presser bar which demountably clamps the presser foot shank portion to the presser bar.

A zipper foot 46 extends at the lower end of the shank portion 42 and in the illustrated embodiment is made integral with the shank portion. The zipper foot 46 may be of any conventional type suited for setting concealed zippers and the foot illustrated is similar to that of the above referenced U.S. Pat. No. 3,492,960. The sole 48 of the zipper foot 46 includes a pair of closely spaced parallel grooves 50 and 52 extending in the direction of material travel from the front 54 to the rear 56 of the foot. A needle hole 58 extends vertically through the foot 46 intermediate the grooves 50 and 52.

The grooves 50 and 52 are of a size and shape suited to accept the toothed edge or coil of a concealed zipper. The grooves are preferably angled outwardly away from the needle hole to deflect the zipper teeth away from the needle. This function is illustrated in FIGS. 1 and 2 wherein one half of a concealed zipper 60 including the zipper tape **60*a* and the zipper teeth or coil 60*b* are superposed on the right side of a piece of material 62 adjacent and parallel to an edge 62*a* thereof for setting of the zipper. With the sole 48 of the zipper foot 46 in engagement with the tape 60*a* of the zipper, the zipper teeth or coil 60*b* is disposed within the groove 52 and is accordingly deflected away from the needle to permit a stitch line to be formed immediately adjacent the zipper teeth or coil 60*b*. The groove 50** is provided to enable the same operation to be carried out in the opposite direction or for setting the other half of the zipper in the same direction as illustrated.

Figure 6:
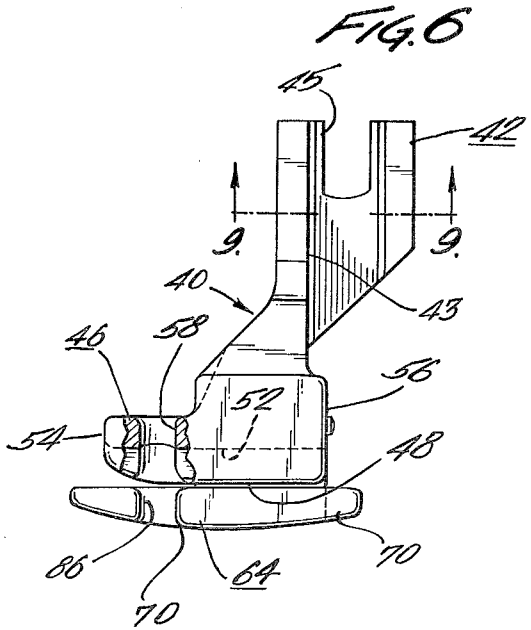
FIGS. 4–6 are respectively enlarged front, left side and right side elevational views of the presser foot attachment in accordance with the present invention as shown in FIGS. 1–3.
Figure 9:
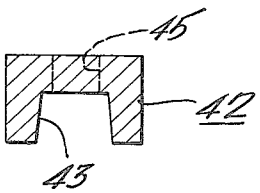
FIG. 9 is a sectional view taken along line 9—9 of FIG. 6.
Figure 4:
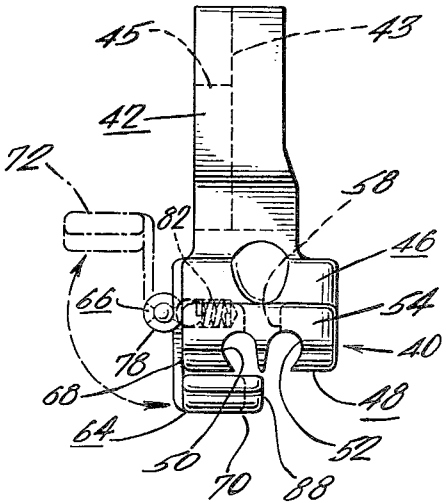
Figure 7:
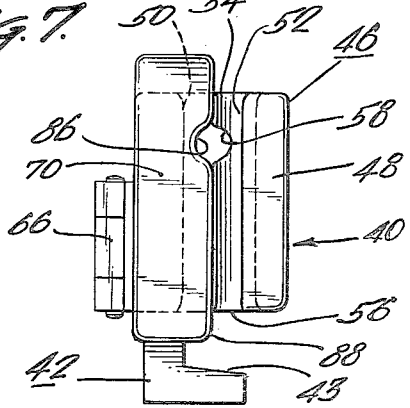
FIG. 7 is a bottom view of the presser foot attachment of FIGS. 1–6.
Figure 5:
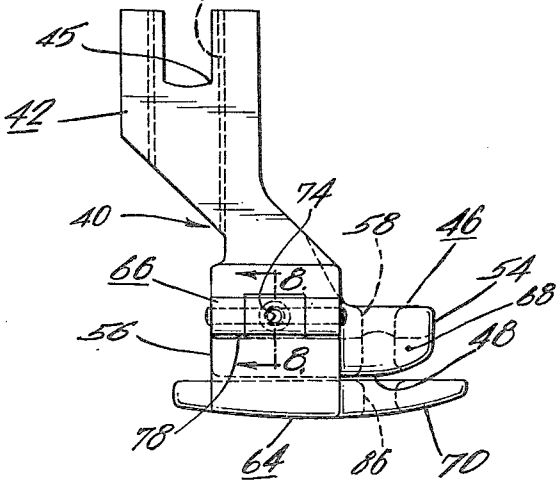

The structure and function of the zipper foot assembly 40 as described thus far is essentially conventional. The novelty of the present assembly resides in the combination with the described structure of a cording foot bar 64 which is pivotally mounted on the zipper foot 46 by a hinge 66 attached to the left side 68 of the foot 46 as viewed from the front thereof. The cording foot bar 64 may comprise any conventional cording foot configuration which as illustrated is typically characterized by a rocker-shaped sole surface 70. As seen most clearly in FIGS. 5–7, the cording foot bar 64 is adapted for selective movement between a raised inverted inoperative position shown at 72 in broken lines, and a lowered operative position as illustrated in solid lines in those figures.

Figure 8:
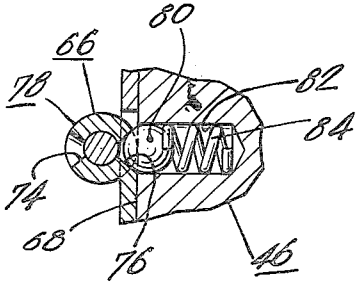
FIG. 8 is an enlarged sectional view taken along line 8—8 of FIG. 5 and showing the spring detent mechanism for holding the cording foot bar in the raised or lowered position.

Means are preferably provided to maintain the cording foot bar 64 in either the raised or the lowered position. Such means in the illustrated embodiment as shown in FIG. 8 comprises a pair of diametrically opposed detents 74 and 76 in the hinge element 78 which rotates with the cording foot bar 64. A ball 80 is slidably disposed within a bore 82 in the zipper foot 46 and is outwardly biased by a coil spring 84. The ball 80 upon engaging either the detent 74 or 76 serves to index and maintain the cording foot bar respectively at the raised or lowered position. The force of the spring 84 is relatively light and the cording foot bar may thus be readily moved from one position to the other with little effort.

A recess 86 in the right hand side 88 of the cording foot bar as viewed from the front thereof aligns with the needle hole 58 of the zipper foot 46 when the cording foot bar is pivoted into the lowered position. This recess provides clearance for the needle and permits the edge 88 to be aligned with the center line of the needle, thus allowing the stitch line to be established along the very edge 88 of the cording foot bar.

The operation of the present presser foot assembly will be evident to those skilled in the art from the foregoing description. The assembly 40 is attached to the presser bar 16 by means of the screw 44 and with the presser bar in the raised position, the cording foot bar 64 is swung into the inoperative position illustrated in FIGS. 1 and 2 to permit the setting of a concealed zipper. The material 62 on which the concealed zipper is to be set is placed right side up on the sewing machine table and one half of zipper 60 is placed on the material with the zipper teeth aligned with the intended seam. The presser bar is then lowered to place the zipper foot 46 in engagement with the zipper tape **60*a* with the zipper teeth extending into the groove 52 as illustrated most clearly in FIG. 2. The zipper half is then set by sewing a stitch line which joins the zipper tape and the material immediately adjacent the zipper teeth or coil 60*b*.** In a similar fashion (not illustrated), the other half of the zipper is attached to the opposite material edge to be joined.

It will be apparent that during the above setting operation, the zipper slide fastener is opened to the fullest extent possible to allow the sewing of the zipper halves along practically the full extent of the zipper. The slide fastener will, however, prevent the attachment of the zipper halves to the material edges along the lower inch or two of the zipper since the presence of the slide fastener blocks the movement of the zipper teeth or coils through the zipper foot.

For closing the seam below the zipper, a stitch line is required which will parallel and lie closely adjacent the stitch lines utilized to secure the zipper to the material and partially overlap those stitch lines to prevent any gap between the zippered seam and the sewn seam. For this purpose, a cording foot on a separate machine is normally employed. However, with the present presser foot assembly, the cording foot bar 64 is simply pivoted into the operative lowered position to carry out this function.

With the zipper at least partially closed and the material sections 62 and 99 placed in face to face relation with the edges adjacent the seam in alignment, and with the cording foot bar 64 in the lowered position, the material is placed thereunder to initiate a stitch line closely adjacent and slightly overlapping the stitch lines securing the zipper halves to the respective fabric portions. This operation is illustrated in FIG. 3 wherein stitch line 90 securing the zipper half 60 to the fabric portion 62 and sewn during the step shown in FIGS. 1 and 2 is seen to terminate at 92. Stitch line 94 is the seam closing stitch line being sewn with the cording foot bar and it will be noted that this stitch line starts at 96 and thus slightly overlaps the stitch line 90. A suitable locking stitch (not shown) should be included at the start of the stitch line 94 since this point will determine the lower limit of the movement of the zipper slide fastener 98 although the joined zipper tapes extend below this point. A quilting guide is preferably used to assist the operator in continuing the stitch line 94 at a uniform distance from the material edges but is omitted from the illustrations.

The cording foot bar permits the needle to work very close to the substantial ridge formed by the closed zipper which is present only at the beginning of the sewn seam for a distance of one to two inches. The close proximity of the stitch line 94 to the stitch line 90 can be observed in FIG. 3. At the stage shown in FIG. 3, the presser foot has just about passed the lower end of the zipper and the ridge caused by the zipper is no longer present. Upon completion of the seam 94, the zipper setting and seam closing operation is finished and the cording foot bar is raised to allow the start of the same sequence on the next garment.

As indicated above, some means such as the illustrated spring-detent arrangement is preferably provided to index and maintain the raised or lowered position of the cording foot. This function could be carried out by the correct selection of the frictional resistance of the hinge 66 and this has proved satisfactory in test runs. The hinge resistance may, however, change with repeated pivotal movement and ajustment may occasionally be required.

It should be clear from the above description that the cording foot bar is pivotally moved into the raised or lowered positions only when the presser bar is raised to elevate the presser foot assembly from the table. Although the combination of the zipper foot and cording foot bar in superposed relation will tend to compress the presser bar spring somewhat more than usual, the effect is de minimus and the spring tension can be relaxed slightly if desired.

From the foregoing description, it will be obvious that variations in the structure of the presser foot assembly could be made. For example, the zipper foot 46 may be hingedly attached to the shank portion 42 in the manner shown for example in U.S. Pat. No. 3,492,960. Similarly, the construction of the zipper foot bar and the cording foot could be modified or other types of conventional zipper and cording feet could be substituted for those illustrated.

As indicated above, the present invention could be utilized with any desired combination of presser feet, wherein it is desired to switch from a first presser foot to a second foot to perform sequential sewing operations. For example, a plain presser foot could be combined with a piping foot for operations involving the setting of braid or soutache.

Manifestly, other changes in details of construction could be effected by those skilled in the art without departing from the spirit and scope of the invention.

What is claimed is:

1. A sewing machine presser foot assembly for setting a concealed zipper and closing the zipper seam comprising a zipper foot adapted for setting a concealed zipper, means for attaching said zipper foot to the presser bar of a sewing machine, said zipper foot having a pair of substantially parallel spaced grooves in the sole thereof aligned with the flow of material through the machine, and a needle hole passing vertically through said zipper foot between said grooves, each of said grooves being adapted to receive the teeth or coil of a concealed zipper, a cording foot bar, and means pivotally connecting said cording foot bar to said zipper foot for selective movement thereof into either a raised inoperative position or a lowered operative position beneath said zipper foot.

2. A sewing machine presser foot assembly comprising a first presser foot element, means for attaching said first presser foot element to the spring-loaded presser bar of a sewing machine, a second presser foot element, each of said presser foot elements having a sole surface of a different configuration, said presser foot elements being selectively adapted to hold the material to be sewn in engagement with the feed dogs of the sewing machine, means pivotally attaching said second presser foot element to said first presser foot element to permit a pivotal movement thereof from a raised inoperative position to a lowered operative position directly beneath and in engagement with said first presser foot element, means for selectively maintaining said second presser foot element in either the raised inoperative position or the lowered operative position, said first presser foot element and presser bar being displaced upwardly against the spring force of the presser bar upon movement of the second presser foot element into its lowered operative position therebeneath whereby the sole surface of said second presser foot element is substituted for that of said first presser foot element to hold the material against the feed dogs.

3. The invention as claimed in claim 2 wherein said first presser foot element includes an aperture extending therethrough to receive the sewing machine needle, said aperture providing passage therethrough of the needle in both the upwardly displaced position of the first presser foot element as well as its lowered operative position.

4. The invention as claimed in claim 2 wherein said first presser foot element comprises a zipper foot adapted for setting a concealed zipper, and wherein said second presser foot element comprises a cording foot bar.

5. The invention as claimed in claim 4 wherein said zipper foot includes a pair of substantially parallel spaced grooves in the sole thereof aligned with the flow of material through the machine, and a needle hole passing vertically through said foot between said grooves, each of said grooves being adapted to receive the teeth or coil of a concealed zipper.

6. The invention as claimed in claim 4 wherein said cording foot bar includes a side edge adapted to align with the sewing machine needle in the lowered position of said cording foot bar, and a recess in said cording foot bar edge providing clearance for said needle.

7. The invention as claimed in claim 2 wherein said second presser foot element is connected to said first presser foot element by a hinge.

8. The invention as claimed in claim 7 wherein said means for selectively maintaining said second presser foot element in either a raised inoperative position or a lowered operative position comprises the frictional resistance of said hinge.

9. The invention as claimed in claim 7 wherein said means for maintaining said second presser foot element in either the raised inoperative position or the lowered operative position comprises resilient ball-detent means operatively connected with said hinge.

10. A sewing machine presser foot assembly for setting concealed zippers and closing the zipper seam comprising a zipper foot adapted for setting a concealed zipper, means for attaching said zipper foot to the presser bar of a sewing machine, said zipper foot including a pair of parallel spaced grooves in the sole thereof aligned with the flow of material through said machine, said zipper foot including a needle hole passing vertically through said foot between said grooves, each of said grooves being adapted to receive the teeth or coil of a concealed zipper, a cording foot bar pivotally connected to said zipper foot for selective movement into either a raised inoperative position adjacent said zipper foot or a lowered operative position beneath said zipper foot, one edge of said cording foot bar being aligned with the sewing machine needle in the lowered position of the cording foot bar, a recess in said cording foot bar edge being vertically aligned with said needle hole of said zipper foot in the lowered position of said cording foot bar to provide clearance for the machine needle, and means for maintaining said cording foot bar in either the raised or lowered position.

11. The invention as claimed in claim 10 wherein said edge of said cording foot bar is substantially parallel to said grooves of said zipper foot in the lowered position of said cording foot bar.

12. The invention as claimed in claim 10 wherein said means for maintaining said cording foot bar in either the raised or lowered position comprises a resilient ball-detent means operatively connected therewith.

13. The invention as claimed in claim 10 wherein said cording foot bar is connected to said zipper foot by a hinge, and wherein said means maintaining said cording foot bar in either the raised or lowered position comprises the frictional resistance of said hinge.

* * * * *